United States Patent [19]

Walla

[11] Patent Number: 4,838,624

[45] Date of Patent: Jun. 13, 1989

[54] FURNITURE ANTI-TIP AND LOCK MECHANISM

[75] Inventor: Gregg W. Walla, Lake Bluff, Ill.

[73] Assignee: Timerline Supply, Lake Bluff, Ill.

[21] Appl. No.: 151,823

[22] Filed: Feb. 3, 1988

[51] Int. Cl.[4] ..... E05C 7/06

[52] U.S. Cl. ..... 312/221; 292/140

[58] Field of Search ..... 312/216, 219, 221; 292/140, 83, 10

[56] References Cited

U.S. PATENT DOCUMENTS 1,462,805 7/1923 Gibson ..... 292/140

4,609,233 9/1986 Walla ..... 312/216 X

*Primary Examiner*—Joseph Falk

*Attorney, Agent, or Firm*—Wood, Dalton, Phillips, Mason & Rowe

[57] ABSTRACT

An improvement in an actuator of the type having a slide plate with an L-shaped slot, guide structure for movement of the slide plate in a reciprocating path between locked and unlocked positions, structure for connecting the slide plate to a locking member so that the locking member follows reciprocating movement of the slide plate, a crank for rotation about an axis and having a pin offset from the axis, and structure mounting the crank to the channel so that the crank is rotatable back and forth about its axis through a predetermined range with the pin in the slot to thereby cause the pin to engage and shift the slide plate between its locked position and its unlocked position upon the crank being rotated. With the pin at the juncture of the two slot legs, the slide bar can be shifted to its unlocked position without rotating the crank. With the pin so situated and all drawers closed, the crank is jammed and cannot be rotated. Structure is provided to permit rotation of the crank with the pin otherwise situated in its jammed position. To accomplish this, the slide plate has a deflectable tab with transverse edges bounding a portion of the L-shaped slot. The crank can be rotated in one direction to thereby move the pin from its jammed position at the bottom of the vertical slot leg against the tab, which is thereby deformed to allow passage of the pin into the horizontal slot leg. Thereafter, the crank can be rotated opposite to the one direction to normally move the slide plate and associated locking bar to its open position.

13 Claims, 1 Drawing Sheet

FIG. 1
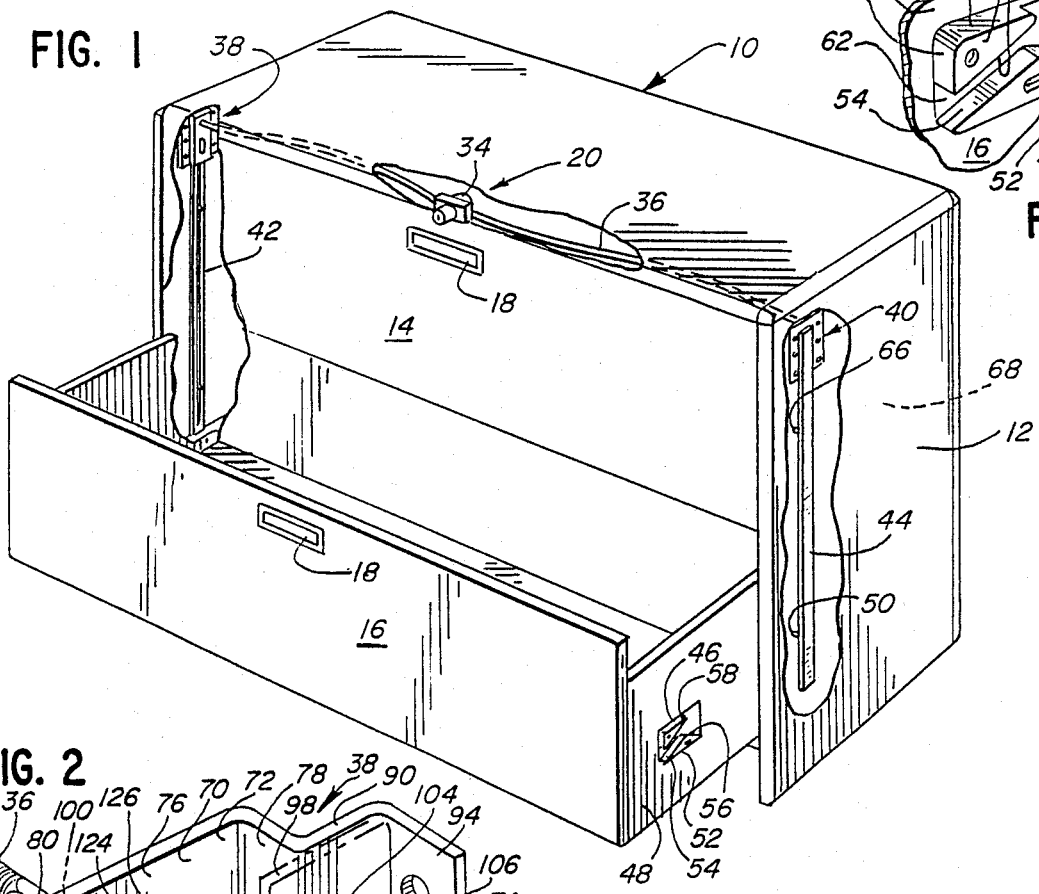
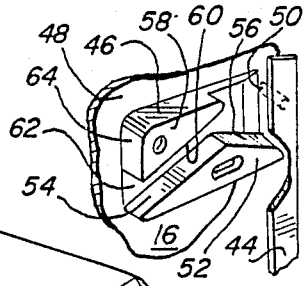
FIG. 9
FIG. 2
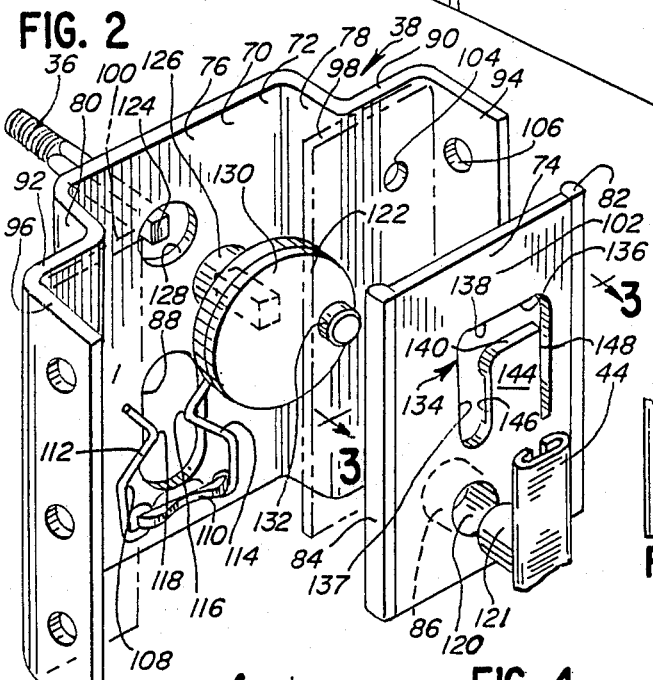
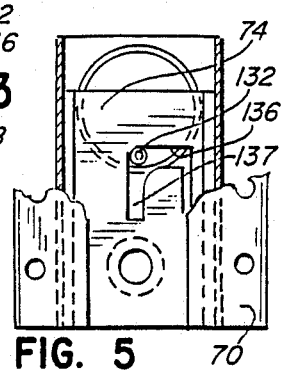
FIG. 5
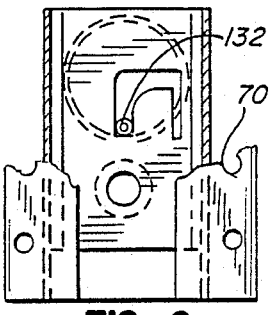
FIG. 6
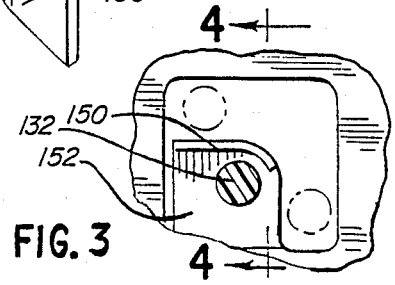
FIG. 3
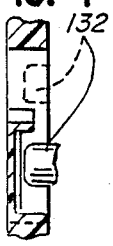
FIG. 4
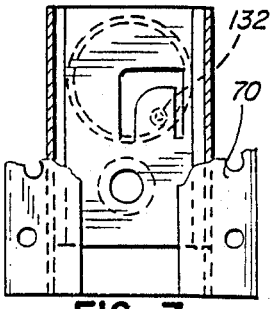
FIG. 7
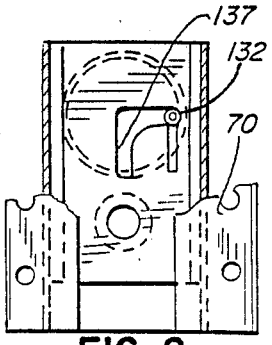
FIG. 8

FURNITURE ANTI-TIP AND LOCK MECHANISM

BACKGROUND OF THE INVENTION

1. Field of the Invention

This invention relates to crank-type actuators for controlling a translating locking bar for drawers in furniture systems and, more particularly, to structure for preventing jamming of the crank.

2. Background Art

One type of drawer locking system is disclosed in my U.S. Pat. No. 4,609,233. That system is designed for use with a piece of furniture having at least two vertically stacked drawers, each of which has a ramp plate defining an entry slot. A vertically reciprocating locking bar has associated lugs and, through a keyed operator/actuator assembly, is selectively positioned to situate the lugs either in a closed, blocking position with the ramp plates, to thereby prohibit opening of the drawers, or an open position, wherein the lugs each align with a slot in the ramp plates. In this latter position of the locking bar, opening of one of the drawers causes the ramp plate thereon to deflect the locking bar from its open to its closed position, thereby prohibiting opening of the remaining drawer(s). This arrangement prevents opening of more than one drawer as might cause the piece of furniture to tip.

The locking bar position is controlled by a keyed operator which, through a rotary cable, operates a crank-type actuator that is directly attached to and moves the locking bar. The actuator converts rotary motion of the cable into translatory vertical movement of the locking bar. To accomplish this, the actuator has a slide plate which is guided in a channel attached to a frame in which the drawers are slidably mounted. The slide plate has an L-shaped slot with intersecting horizontal and vertical legs. The crank, which is driven by the cable, is journalled for rotation in the channel about an axis and has an eccentric pin which is guided in the L-shaped slot. Rotation of the crank in one direction, with the pin in the horizontal slot leg, causes the pin to drive the slide plate upwardly into the locked position. Opposite rotation of the crank causes the pin to drive the slide plate downwardly into its unlocked position. With the slide plate in its unlocked position, the pin resides at the junction of the horizontal and vertical legs. Thereupon, withdrawal of one of the drawers forces the locking plate and thereby the slide plate upwardly so that the pin resides at the bottom of the vertical leg. Closing of the open drawer slides the locking bar vertically upwardly to its unlocked position so that any drawer can thereafter be pulled out.

While the above system has proven to be very effective, under normal operating conditions, there has been one drawback. The furniture may be jolted, as upon being dropped during shipping or handling, and the locking bar as a result may shift from its open to its closed position with all of the drawers closed. The crank then becomes jammed with the pin residing in the bottom of the vertical leg. This condition is remedied by gaining access to the locking bar and manually shifting it to its unlocked position. This is an inconvenience that may also necessitate expensive service calls.

SUMMARY OF THE INVENTION

The present invention is specifically directed to overcoming the above problem in a novel and simple manner.

The present invention is an improvement in an actuator of the type having a slide plate with an L-shaped slot, guide structure for movement of the slide plate in a reciprocating path between locked and unlocked positions, structure for connecting the plate to a locking member so that the locking member follows reciprocating movement of the slide plate, a crank for rotation about an axis and having a pin offset from the axis, and structure mounting the crank to the channel so that the crank is rotatable back and forth about its axis through a predetermined range with the pin in the slot to thereby cause the pin to engage and shift the slide plate between its locked position and its unlocked position upon the crank being rotated. With the pin at the juncture of the two slot legs, the slide bar can be shifted to its locked position without rotating the crank. With the pin so situated and all drawers closed, the crank is jammed and cannot be rotated.

According to the invention, structure is provided to permit rotation of the crank with the pin otherwise situated in its jammed position. To accomplish this, the slide plate has a deflectable tab with transverse edges bounding a portion of the L-shaped slot. The crank can be rotated in one direction to thereby move the pin from its jammed position at the bottom of the vertical slot leg against the tab, which is thereby deformed to allow passage of the pin into the horizontal slot leg. Thereafter, the crank can be rotated opposite to the one direction to normally move the slide plate and associated locking bar to its open position.

In a preferred form, the tab is integrally formed with the slide plate and is carried in deflectable, cantilever fashion.

The tab has a wall surface facing the crank, which is preferably ramped to permit progressive deflection of the tab as the pin moves thereagainst upon rotation of the crank in the one direction from its jammed position. Once the pin moves past the tab into the slot, the tab reassumes its undeformed state and one edge thereof can be used as a drive surface against which the pin can act to move the slide plate from its locked position to its unlocked position.

Preferably, the slide plate is molded from plastic as a single piece, to include the flexible tab.

BRIEF DESCRIPTION OF THE DRAWINGS

FIG. 1 is a perspective view of a conventional desk with vertically stacked drawers and having incorporated therein a locking system with an improved actuator according to the present invention;

FIG. 2 is an enlarged, exploded, perspective view of the actuator in FIG. 1, consisting of a channel, crank and slotted slide plate;

FIG. 3 is a partial section view of the crank and slide plate taken along line 3—3 of FIG. 2 showing the transition position for the crank from a jammed position;

FIG. 4 is a section view of the crank and slide plate taken along line 4—4 of FIG. 3;

FIG. 5 is an elevation view of the actuator with the slide plate in its unlocked position and all drawers closed;

FIG. 6 is an elevation view of the actuator with the slide plate in its locked position and the crank jammed with all drawers closed;

FIG. 7 is an elevation view of the actuator with the crank partially reset from the jammed position of FIG. 6;

FIG. 8 is an elevation view of the actuator with the slide plate in its locked position and all drawers closed; and FIG. 9 is an enlarged perspective view of a ramp plate on one of the drawers shown in relationship to a portion of a locking bar on the locking system.

DETAILED DESCRIPTION OF THE DRAWINGS

In FIG. 1, a conventional lateral file is shown at 10 and consists of a cabinet 12 with internal framework that mounts vertically spaced drawers 14, 16 for fore and aft sliding movement relative to the cabinet 12. A recessed pull 18 is provided on each drawer 14, 16 to facilitate withdrawal of the drawers 14, 16 from the closed position, in which the lower drawer 16 is shown in FIG. 1, to an open position, in which the upper drawer 14 is shown in FIG. 1 and wherein access can be gained to the inside of the drawer 16.

The drawers 14, 16 are selectively secured in their closed position by a locking system, shown generally at 20 in FIG. 1, and consisting of a keyed operator 34 for rotating a cable 36, actuators 38, 40 which are operated by the ends of the rotary cable 36, and locking bars 42, 44, responsive to movement of the actuators 38, 40, for selectively locking the drawers 14, 16. The structure of actuators 38, 40 is wherein the present invention resides and this structure converts rotary motion of the cable 36 into vertical reciprocating movement of the locking bars 42, 44, as described more fully below.

The operation of locking bar 44 will now be described with respect to one exemplary drawer 16, with reference specifically to FIGS. 1 and 9. The drawer 16 has a ramp plate 46 attached to a laterally facing surface 48 on the drawer 16. The ramp plate 46 cooperates with a laterally projecting lug 50 on the locking bar 44. More specifically, the ramp plate 46 has an inverted V-shaped section 52 defining sloping ramp surfaces 54, 56. A second section 58 has an underside surface 60 that is generally parallel to the ramp surface 54 and spaced slightly thereabove so as to define a slot 62 that has a vertical dimension substantially greater than the diameter of the lug 50.

With the drawer 16 in the closed position of FIG. 1, the lug 50 resides in front of the ramp plate 46. The locking bar 44 is movable vertically between a locked position, wherein the lug 50 is in front of a vertically extending blocking surface 64, and an unlocked position, wherein the lug 50 is aligned vertically with the slot 62. If one attempts to withdraw the drawer 16 with the locking bar 44 in its locked position, the lug 50 interferes with the blocking surface 64, thereby prohibiting opening of the drawer 16. With the locking bar 44 in its unlocked position, the lug 50 aligns with the slot 62 and upon withdrawal of the drawer 16, the lug rides up ramp surface 54, thereby shifting the locking bar 44 in the process to its locked position. The drawer 16 can be freely withdrawn, while the drawer 14 thereabove is locked by reason of the cooperation of a separate lug 66 with a second ramp plate (not shown) on the side wall 68 of drawer 14. This arrangement prohibits withdrawal of both drawers 14, 16 as might cause the field 10 to be unbalanced and prone to being tipped. Locking bar 42 on the opposite side of the file 10 operates in the same manner as bar 44. Upon the drawer 16 being closed, the lug 50 moves against ramp surface 60 and is thereby deflected with bar 44 downwardly into its unlocked position as the door 14 realizes its closed position, thereby making possible opening of either drawer 14, 16. Opening of drawer 14 locks drawer 16 in similar fashion.

Reference is now made to FIGS. 1–8, wherein details of the inventive actuators 38, 40 are shown. Each actuator 38, 40 operates in the same manner and thus discussion herein will be limited to exemplary actuator 38. The actuator 38 consists of a metal channel 70 having a U-shaped seat 72 for a generally rectangular slide plate 74. The seat 72 is bounded by a base 76 and spaced legs 78, 80. The slide plate 74, which is preferably molded from plastic, has integral rails 82, 84 for guiding vertical movement of the slide plate 74 relative to the channel 70. The range of vertical movement of the slide plate 74 is limited by a lug 86 on the plate 74, which is guided in an oval slot 88 in the channel base 76. The slide plate 74 is held captive in the seat 72 by legs 78, 80, which have portions 90, 92, respectively, folded laterally outwardly and portions 94, 96 doubled back on leg sections 90, 92 respectively, so that wall surfaces 98, 100 on leg sections 94, 96 overlie the outwardly facing wall surface 102 of of the slide plate 74. By extending fasteners (not shown) through bores 104 in the leg sections 90, 92 and aligned bores 106 in the leg sections 94, 96, and into the frame 28, the leg sections 90, 92, 94, 96 are held in doubled back relationship so that the slide plate 74 cannot escape from the channel 70 with the actuator 38 assembled to the file 10.

A wire spring 108 is held in place on the base 76 on a rib 110 struck directly therefrom. The spring 108 has legs 112, 114, inwardly bent in the shape of a V to define apexes 116, 118 spaced less than the width of the slot 88. The lug 86 on the slide plate 74 is movable from the locked position wherein the slug 86 resides in the slot above the apexes 116, 118 to an unlocked position wherein the lug 86 resides below the apexes 116, 118 in the slot 88. In the transition between the locked and unlocked positions for the slide plate 74, the lug 86 encounters the apexes 116, 118 and thereby deflects the spring legs 112, 114 away from each other. The restoring force in the legs 112, 114 tends to urge the leg 86 towards each of the locked and unlocked positions therefor.

The lug 86 has a through bore 120 which accepts a lug 121 on the locking bar 44. The locking bar 44 thereby follows vertical movement of the slide plate 74.

To convert rotary motion of the cable 36 into translatory movement of the slide plate 74, a crank 122 is keyed to the cable end 124 to follow rotation thereof and is situated between the channel base 76 and the slide plate 74. The crank 122 has a cylindrical body 126 guided for rotation in a bore 128 in the channel 70, and an integral disk 130 carrying a pin 132 that is offset from the axis of rotation of the crank 122. The pin 132 cooperates with an L-shaped slot 134 in the slide plate 74 having a horizontal leg 136 and a connecting vertical leg 137. Rotation of the crank 122 in a counterclockwise direction in FIG. 2 bears the pin 132 against edge 138 bounding the horizontal leg 136 and thereby draws the slide plate 74 into its locked position shown in FIG. 8. Rotation of the crank in a clockwise direction bears the pin 132 against edge 140 to thereby shift the slide plate 74 downwardly into its unlocked position. Upon the unlocked position of FIG. 5 being realized, the pin 132 resides at the juncture of the horizontal slot leg 136 and vertical leg 137. With the slide plate 74 in the unlocked position of FIG. 5 and one of the drawers 14, 16 opened, the locking bar 42 is forced upwardly by the ramp plate 46 on the opening drawer so that the slide plate 74 is carried thereby upwardly to the FIG. 6 position. It is also possible for the slide plate 74 to be moved from the FIG. 5 position to the FIG. 6 position as by jolting the furniture with the drawers 24, 26 both closed, as frequently occurs during shipping or handling. With the actuator 38 in the FIG. 6 position and both drawers 14, 16 closed, the crank 122 is jammed i.e. cannot rotate, thereby making the locking system 20 inoperable. It is this condition that the inventive structure is intended to overcome.

According to the invention, a deflectable tab 144 is integrally formed with the slide plate 74. The tab 144 has a generally rectangular configuration and is integrally attached at its lower end to the slide plate 74 so that a cantilever-type connection is made therewith. The tab 144 has a wedge-shaped configuration increasing in thickness progressively laterally from vertical edge 146, bounding the vertical slot 137 to its opposite free edge 148. The tab 144 has a thickened ridge 150 defining the edge 140 bounding the horizontal slot leg 136.

The pin 132, upon the crank 122 being rotated counterclockwise from the FIG. 6 position, moves past edge 146 and against ramped surface 152 facing the crank 122 and progressively deflects the tab 144 away from the crank 122. Eventually, the tab 144 is deflected sufficiently away from the crank that the pin 132 can move past the ridge 150 into the horizontal slot leg 137 as shown in FIG. 8. In FIG. 7, the pin 132 is shown approximately midway between the FIG. 6 and FIG. 8 positions. Once the FIG. 8 position is realized, the crank 122 can be rotated in a clockwise direction, thereby bearing the pin 132 against the edge 140 so as to move the locking bar 44 to its open position.

It can be seen that the inventive structure obviates the need to manually manipulate the locking bar 42 with the actuator in the FIG. 6 position and both drawers closed. Thus by simply turning a key 154 for the operator 34, the jammed position of FIG. 6 can be overcome and the system reset for normal operation.

I claim:

1. An actuator assembly comprising:

a slide plate having an L-shaped slot with first and second interconnecting legs;

channel means for guiding movement of the slide plate in a reciprocating path between a locked position and an unlocked position;

means for connecting the slide plate to a locking member so that the locking member can follow reciprocating movement of the slide plate;

a crank for rotation about an axis with an associated pin offset from said axis;

means mounting the crank to the channel means so that the crank is rotatable back and forth about the axis through a predetermined range with the pin in the slot to thereby cause the pin to engage and shift the slide plate between its locked position and its unlocked position as the crank is rotated;

said pin residing in the slot in a first position in alignment with both the first and second legs with the slide plate in an unlocked position and movable upon rotation of the crank in a first direction to a second position in one of the first and second legs out of alignment with the other of the legs with the slide plate in a locked position; and cooperating means on the crank and slide plate for permitting rotation of the crank relative to the slide plate in the first direction with the pin in a third position in which the pin is in the other slot leg and out of alignment with the one leg and the slide plate in the locked position sufficiently to situate the pin in the second position to thereby prevent jamming of the crank with the pin in said third position.

2. The actuator assembly according to claim 1 wherein said means for permitting rotation of the crank comprises a deflectable tab on said slide plate with a side facing the crank and means on said tab to permit movement of the pin out of the other slot leg and against the tab side to thereby deflect the tab so that the pin can move into the one slot leg.

3. The actuator assembly according to claim 2 wherein the tab is struck directly from the slide plate.

4. An actuator assembly comprising:

a slide plate having an L-shaped slot with first and second interconnecting legs;

channel means for guiding movement of the slide plate in a reciprocating path between a locked position and an unlocked position;

means for connecting the slide plate to a locking member so that the locking member can follow reciprocating movement of the slide plate;

a crank for rotation about an axis with an associated pin offset from said axis;

means mounting the crank to the channel means so that the crank is rotatable back and forth about the axis through a predetermined range with the pin in the slot to thereby cause the pin to engage and shift the slide plate between its locked position and its unlocked position as the crank is rotated, said pin residing in the slot in a first position in alignment with both the first and second legs with the slide plate in an unlocked position and movable upon rotation of the crank in a first direction to a second position in one of the first and second legs out of alignment with the other of the legs with the slide plate in a locked position; and means for permitting rotation of the crank in the first direction with the pin in a third position in which the pin is in the other slot leg and out of alignment with the one leg and the slide plate in the locked position so that the pin can realize said second position to thereby prevent jamming of the crank with the pin in said third position, wherein said means for permitting rotation of the crank comprises a deflectable tab on said slide plate with a side facing the crank and means on said tab to permit movement of the pin out of the other slot leg and against the tab side to thereby deflect the tab so that the pin can move into the one slot leg, wherein said slide plate has a body with a substantially uniform thickness and the tab has at least a portion with a thickness less than the thickness of the slide plate body.

5. The actuator assembly according to claim 2 wherein said tab has an edge that bounds a portion of the one slot leg.

6. An actuator assembly comprising:

a slide plate having an L-shaped slot with first and second interconnecting legs;

channel means for guiding movement of the slide plate in a reciprocating path between a locked position and an unlocked position;

means for connecting the slide plate to a locking member so that the locking member can follow reciprocating movement of the slide plate;

a crank for rotation about an axis with an associated pin offset from said axis;

means mounting the crank to the channel means so that the crank is rotatable back and forth about the axis through a predetermined range with the pin in the slot to thereby cause the pin to engage and shift the slide plate between its locked position and its unlocked position as the crank is rotated, said pin residing in the slot in a first position in alignment with both the first and second legs with the slide plate in an unlocked position and movable upon rotation of the crank in a first direction to a second position in one of the first and second legs out of alignment with the other of the legs with the slide plate in a locked position; and means for permitting rotation of the crank in the first direction with the pin in a third position in which the pin is in the other slot leg and out of alignment with the one leg and the slide plate in the locked position so that the pin can realize said second position to thereby prevent jamming of the crank with the pin in said third position, wherein said means for permitting rotation of the crank comprises a deflectable tab on said slide plate with a side facing the crank and means on said tab to permit movement of the pin out of the other slot leg and against the tab side to thereby deflect the tab so that the pin can move into the one slot leg, wherein the tab side has a ramp surface to progressively deflect the tab as the crank is rotated in the first direction with the pin in the third position.

7. The actuator assembly according to claim 4 wherein said tab as a thickened ridge that bounds a portion of the one slot leg and against which the pin bears to prevent movement of the pin against the tab side as the crank is rotated opposite to the first direction from the second pin position.

8. In an article of furniture having a frame, first and second drawers slidably mounted on the frame for independent movement selectively between open and closed positions, a locking bar mounted for movement selectively between a locked position and an unlocked position, cooperating means on the locking bar and first and second drawers to prevent movement of each of the first and second drawers from the closed position to the open position with the locking bar in the locked position, means on at least one of the drawers for moving the locking bar to the locked position as the one drawer is moved from the closed position to the open position to thereby prevent opening of the other drawer as might cause tipping of the furniture article, and an actuator operative associated with the locking bar for controlling movement of the locking bar between its locked and unlocked positions, the improvement wherein said actuator comprises:

a slide plate having a generally L-shaped slot with first and second transverse legs;

channel means for guiding movement of the slide plate in a reciprocative path between a locked position and an unlocked position;

means connecting the locking bar to the slide plate so that the locking bar follows reciprocative movement of the slide plate and thereby moves between its locked position and its unlocked position;

a crank;

means mounting the crank to the channel means for rotation about a first axis;

a pin on the crank spaced from the first axis, said pin extending into said L-shaped slot and upon said crank being rotated in one direction moving in one said slot leg between a first aligned position with said other slot leg with the slide plate and locking bar in their unlocked position and a second position wherein the pin is misaligned with the other slot leg with the locking bar and slide plate in their locked position and as an incident thereof engaging and moving the slide plate from its unlocked position to its locked position, said slide plate and locking bar being movable in response to opening of one of said drawers to their locked positions to thereby situate the pin in the other slot arm in a third position wherein the pin is misaligned with the one slot arm; and cooperating means on the slide plate and crank for permitting rotation of the crank in the one direction for movement of the pin from said third position to the second position without moving the entire slide plate;

whereby in the even that the slide plate and locking bar are inadvertently moved from their unlocked to their locked positions with the pin in the first position and both the first and second drawers in their closed positions, the locking bar and slide plate can be moved to their unlocked position by first rotating the crank in the one direction to move the pin from its third position to its second position and thereafter rotating the crank opposite to the one direction to move the pin from its second position into its first position and as an incident thereof to shift the locking bar and slide plate from their locked to their unlocked positions.

9. The improved actuator according to claim 8 wherein said means for permitting rotation of the crank comprises a deflectable tab with a side facing the crank on said slide plate and means on said tab to permit movement of the pin out of the other slot leg and against the tab side to thereby deflect the tab so that the pin can move into the one slot leg.

10. The actuator assembly according to claim 9 wherein the tab is struck directly from the slide plate.

11. In an article of furniture having a frame, first and second drawers slidably mounted on the frame for independent movement selectively between open and closed positions, a locking bar mounted for movement selectively between a locked position and an unlocked position, cooperating means on the locking bar and first and second drawers to prevent movement of each of the first and second drawers from the closed position to the open position with the locking bar in the locked position, means on at least one of the drawers for moving the locking bar to the locked position as the one drawer is moved from the closed position to the open position to thereby prevent opening of the other drawer as might cause tipping of the furniture article, and an actuator operatively associated with the locking bar for controlling movement of the locking bar between its locked and unlocked positions, the improvement wherein said actuator comprises:

a slide plate having a generally L-shaped slot with first and second transverse legs;

channel means for guiding movement of the slide plate in a reciprocative path between a locked position and an unlocked position;

means connecting the locking bar to the slide plate so that the locking bar follows reciprocative movement of the slide plate and thereby moves between its locked position and its unlocked position;

a crank;

means mounting the crank to the channel means for rotation about a first axis;

a pin on the crank spaced from the first axis, said pin extending into said L-shaped slot and upon said crank being rotated in one direction moving in one said slot leg between a first aligned position with said other slot leg with the slide plate and locking bar in their unlocked position and a second position wherein the pin is misaligned with the other slot leg with the locking bar and slide plate in their locked position and as an incident thereof engaging and moving the slide plate from its unlocked position to its locked position, said slide plate and locking bar being movable in response to opening of one said drawers to their locked positions to thereby situate the pin in the other slot arm in a third position wherein the pin is misaligned with the one slot arm; and means for permitting rotation of the crank in the one direction for movement of the pin from said third position to the second position without moving the slide plate, whereby in the event that the slide plate and locking bar are inadvertently moved from their unlocked to their locked positions with the pin in the first position and both the first and second drawers in their closed positions, the locking bar and slide plate can be moved to their unlocked position by first rotating the crank in the one direction to move the pin from its third position to its second position and thereafter rotating the crank opposite to the one direction to move the pin from its second position into its first position and as an incident thereof to shift the locking bar and slide plate from their locked to their unlocked positions, wherein said means for permitting rotation of the crank comprises a deflectable tab with a side facing the crank on said slide plate and means on said tab to permit movement of the pin out of the other slot leg and against the tab side to thereby deflect the tab so that the pin can move into the one slot leg, wherein said slide plate has a body with a substantially uniform thickness and the tab has at least a portion with a thickness less than the thickness of the slide plate body.

12. In an article of furniture having a frame, first and second drawers slidably mounted on the frame for independent movement selectively between open and closed positions, a locking bar mounted for movement selectively between a locked position and an unlocked position, cooperating means on the locking bar and first and second drawers to prevent movement of each of the first and second drawers from the closed position to the open position with the locking bar in the locked position, means on at least one of the drawers for moving the locking bar to the locked position as the one drawer is moved from the closed position to the open position to thereby prevent opening of the other drawer as might cause tipping of the furniture article, and an actuator operatively associated with the locking bar for controlling movement of the locking bar between its locked and unlocked positions, the improvement wherein said actuator comprises:

a slide plate having a generally L-shaped slot with first and second transverse legs;

channel means for guiding movement of the slide plate in a reciprocative path between a locked position and an unlocked position;

means connecting the locking bar to the slide plate so that the locking bar follows reciprocative movement of the slide plate and thereby moves between its locked position and its unlocked position;

a crank;

means mounting the crank to the channel means for rotation about a first axis;

a pin on the crank spaced from the first axis;

said pin extending into said L-shaped slot and upon said crank being rotated in one direction moving in one said slot leg between a first aligned position with said other slot leg with the slide plate and locking bar in their unlocked position and a second position wherein the pin is misaligned with the other slot leg with the locking bar and slide plate in their locked position and as an incident thereof engaging and moving the slide plate from its unlocked position to its locked position, said slide plate and locking bar being movable in response to opening of one said drawers to their locked positions to thereby situate the pin in the other slot arm in a third position wherein the pin is misaligned with the one slot arm; and means for permitting rotation of the crank in the one direction for movement of the pin from said third position to the second position without movement the slide plate, wherein in the event that the slide plate and locking bar are inadvertently moved from their unlocked to their locked positions with the pin in the first position and both the first and second drawers in their closed positions, the locking bar and slide plate can be moved to their unlocked position by first rotating the crank in the one direction to move the pin from its third position to its second position and thereafter rotating the crank opposite to the one direction to move the pin from its second position into its first position and as an incident thereof to shift the locking bar and slide plate from their locked to their unlocked positions, wherein said means for permitting rotation of the crank comprises a deflectable tab with a side facing the crank on said slide plate and means on said tab to permit movement of the pin out of the other slot leg and against the tab side to thereby deflect the tab so that the pin can move into the one slot leg, wherein said tab has a thickened ridge that defines an edge bounding a portion of the one slot leg.

13. In an article of furniture having a frame, first and second drawers slidably mounted on the frame for independent movement selectively between open and closed positions, a locking bar mounted for movement selectively between a locked position and an unlocked position, cooperating means on the locking bar and first and second drawers to prevent movement of each of the first and second drawers from the closed position to the open position with the locking bar in the locked position, means on at least one of the drawers for moving the locking bar to the locked position as the one drawer is moved from the closed position to the open position to thereby prevent opening of the other drawer as might cause tipping of the furniture article, and an actuator operatively associated with the locking bar for controlling movement of the locking bar between its locked and unlocked positions, the improvement wherein said actuator comprises:

a slide plate having a generally L-shaped slot with first and second transverse legs;

channel means for guiding movement of the slide plate in a reciprocative path between a locked position and an unlocked position;

means connecting the locking bar to the slide plate so that the locking bar follows reciprocative movement of the slide plate and thereby moves between its locked position and its unlocked position;

a crank;

means mounting the crank to the channel means for rotation about a first axis;

a pin on the crank spaced from the first axis, said pin extending into said L-shaped slot and upon said crank being rotated in one direction moving in one said slot leg between a first aligned position with said other slot leg with a slide plate and locking bar in their unlocked position and a second position wherein the pin is misaligned with the other slot leg with the locking bar and slide plate in their locked position and as an incident thereof engaging and moving the slide plate from its unlocked position to its locked position, said slide plate and locking bar being movable in response to opening of one said drawers to their locked positions to thereby situate the pin in the other slot arm in a third position wherein the pin is misaligned with the one slot arm; and means for permitting rotation of the crank in the one direction for movement of the pin from said third position to the second position without moving the slide plate, whereby in the event that the slide plate and locking bar are inadvertently moved from their unlocked to their locked positions with the pin in the first position and both the first and second drawers in their closed positions, the locking bar and slide plate can be moved to their unlocked position by first rotating the crank in the one direction to move the pin from its third position to its second position and thereafter rotating the crank opposite to the one direction to move the pin from its second position into its first position and as an incident thereof to shift the locking bar and slide plate from their locked to their unlocked positions, wherein said means for permitting rotation of the crank comprises a deflectable tab with a side facing the crank on said slide plate and means on said tab to permit movement of the pin out of the other slot leg and against the tab side to thereby deflect the tab so that the pin can move into the one slot leg, wherein said tab has a ramp surface against which the pin bears to progressively deflect the tab as the crank is rotated in the first direction with the pin starting in the third position.

* * * * *

UNITED STATES PATENT AND TRADEMARK OFFICE

CERTIFICATE OF CORRECTION

PATENT NO. : 4,838,624

DATED : June 13, 1989

INVENTOR(S) : Gregg W. Walla

It is certified that error appears in the above-identified patent and that said Letters Patent is hereby corrected as shown below:

On the title page assignee should read

--(73) Assignee: Timberline Supply, Lake Bluff, Ill.--.

Signed and Sealed this

Twenty-fourth Day of April, 1990

*Attest:*

HARRY F. MANBECK, JR.

*Attesting Officer*

*Commissioner of Patents and Trademarks*